United States Patent [19]

Lanham et al.

[11] 4,060,434

[45] Nov. 29, 1977

[54] MATCH-HEAD COMPOSITIONS

[75] Inventors: Albert Frank Lanham, Maidstone; Philip Sydney Barned, Welling; Sydney Ralph Potter, London, all of England

[73] Assignee: Bryant and May, London, England

[21] Appl. No.: 693,898

[22] Filed: June 8, 1976

[30] Foreign Application Priority Data

June 11, 1975 United Kingdom ..... 25019/75

[51] Int. Cl.[2] ..... C06B 45/00

[52] U.S. Cl. ..... 149/2; 44/46; 149/19.1; 149/19.6; 149/31; 149/83; 149/18

[58] Field of Search ..... 44/46; 149/2, 19.1, 149/19.6, 31, 83, 18

[56] References Cited

U.S. PATENT DOCUMENTS

| | | | |
|---|---|---|---|
| 2,432,220 | 12/1947 | Weyl | 149/31 |
| 3,321,342 | 5/1967 | Tigrett et al. | 149/19.6 |
| 3,456,589 | 7/1969 | Thomison et al. | 149/2 |
| 3,522,117 | 7/1970 | Atadan et al. | 149/2 |
| 3,775,198 | 11/1973 | Hijikata | 149/2 |
| 3,895,979 | 7/1975 | Kraemer et al. | 149/2 |
| 3,924,405 | 12/1975 | Cohen | 149/2 |

*Primary Examiner*—Edward A. Miller
*Attorney, Agent, or Firm*—Kane, Dalsimer, Kane, Sullivan and Kurucz

[57] ABSTRACT

The match-head compositions have a content of microscopic hollow particles or "microspheres", generally 10 to 1000 microns in diameter. Compositions may be formulated for any type of match. Microspheres are described having walls of siliceous materials, plastics materials (such as phenolic resins) and carbon. The presence of microspheres offers considerable savings in materials, and enables good burning rate and striking sensitivity to be achieved without the need for special aeration measures.

9 Claims, 1 Drawing Figure

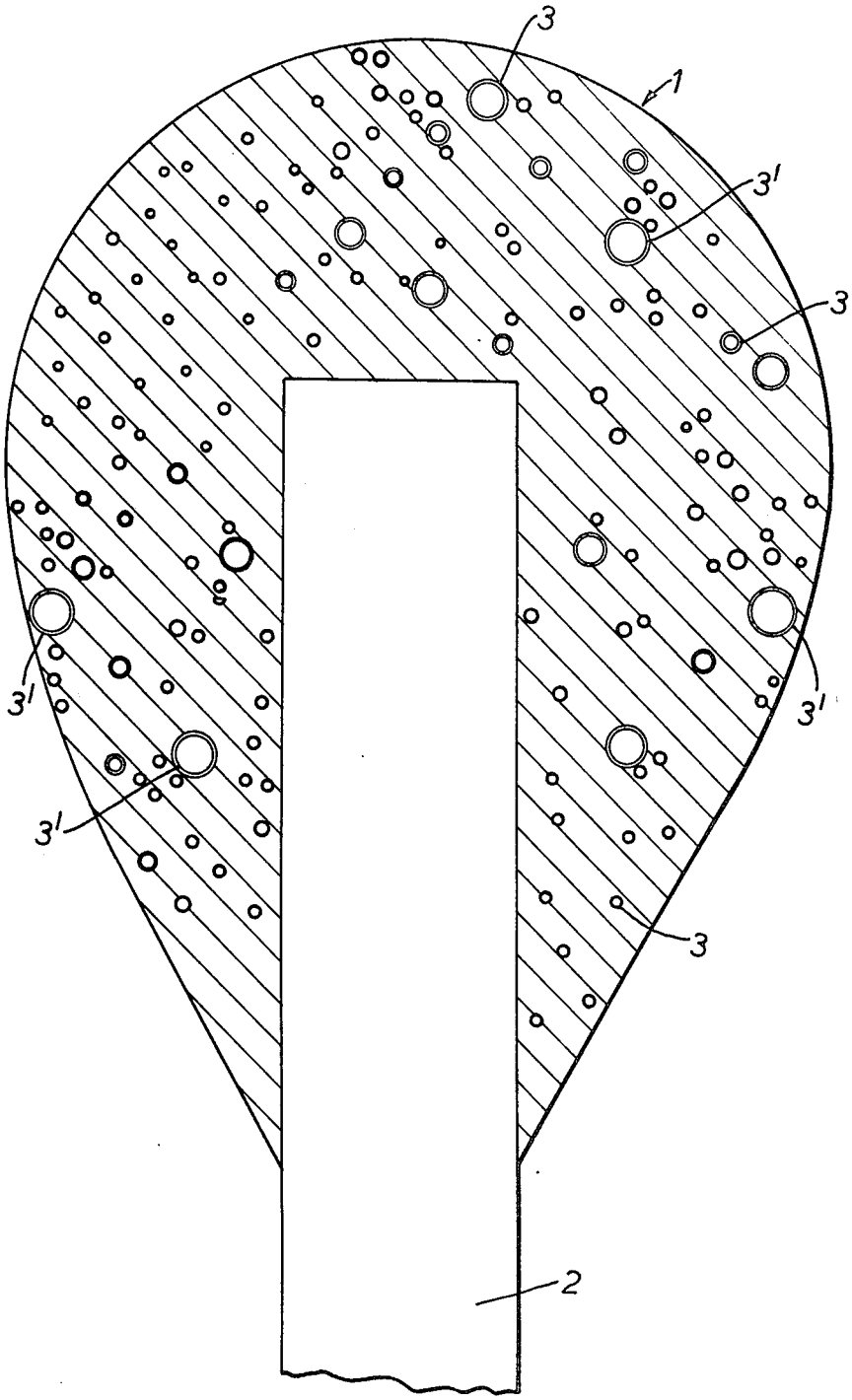
3
1
3'
3
3'
3'
3'
3
2

MATCH-HEAD COMPOSITIONS

This invention relates to match-head compositions and provides a match-head composition having a content of microscopic hollow particles.

For convenience, the microscopic hollow particles incorporated in match-head compositions according to the invention will hereinafter be referred to as "microspheres". Microspheres may be defined as microscopic hollow spheres or balloons, preferably thin-walled. In general, microspheres have sizes in the range of from 5 to 5000 microns, but for the purposes of the present invention the microscopic hollow particles advantageously have sizes in the range of from 10 to 1000 microns. As will be appreciated, the shape of microspheres depends on the particular manufacturing method employed; in particular, the microspheres need not necessarily be exactly spherical and, although substantially spherical particles are preferred, any balloon shape will suffice for the purposes of the present invention.

The incorporation of microspheres in match-head compositions offers a number of advantages. Firstly, good striking sensitivity and burning rate can be achieved without taking special steps as previously practised which effected extensive random entrainment of air bubbles. This avoidance or reduction of such air entrainment prevents or reduces the loss of head strength normally associated therewith. It also obviates the need to use "high foam" glues, foaming agents or air injection procedures in those formulations in the manufacture of which such measures have previously been taken. Moreover, the presence of microspheres confers increased moisture resistance as compared with aerated match-head compositions, which is especially important in the case of compositions that include phosphorus sesquisulphide (as with so-called "strike-anywhere" matches) because of the resulting decreased decomposition rate thereof.

The second principal advantage of the incorporation of microspheres in match-head compositions is the resulting decrease in the specific gravity of the composition, which in turn enables the same size of match-head to be produced with less material.

Thirdly, as compared with controlling the specific gravity of a match-head composition by aeration as previously practised, the use of microspheres permits much easier and consequently more reliable control of specific gravity from batch to batch, which is clearly a considerable advantage in large-scale production.

In principle, compositions may be formulated in accordance with the invention for any type of match such as, for example, safety matches (including so-called "book matches"), "strike-anywhere" matches, Bengal Lights and Lifeboat Flamers. The term "match-head composition" is accordingly intended to include any pyrotechnic composition which is intended to be ignited by striking across a surface, whether a prepared surface or otherwise.

Microspheres may be incorporated in match-head compositions for use in making so-called "double dip" matches. In such matches, a bulb of a first composition is applied initially to the match stick or splint, and a second composition is then applied to the bulb in a second dipping operation. The first and second dip compositions may be the same but usually a thin layer or "button" of a relatively sensitive composition is applied to a bulb of a composition which is rather less sensitive but has good burning properties. Such composite heads may be formulated for safety matches or "strike-anywhere" matches, and the microspheres may be incorporated in either the first or second dip compositions or in both. The first and second compositions may be coloured the same or different. It will be appreciated that Bengal Lights and Lifeboat Flamers may be regarded as special instances of "double dip" matches.

The invention also provides a match or other rod-like article, for example, a self-ignitable cigarette (or cigar or cigarillo) having thereon a match-head pyrotechnic composition as herein defined and having a content of microspheres.

Advantageously, the microsphere walls comprise a siliceous material (which may for instance be a ceramic or glass or glass-like material) or another material which is noncombustible, that is to say, chemically inert under the conditions prevailing on combustion of the match-head composition. An especially suitable microsphere material is the complex inorganic silicate sold by Armoform Ltd. of Yorkshire, England under the trade name "Armospheres".

Microspheres having walls comprising a plastic material or carbon may prove beneficial in certain formulations. As plastics materials there may be mentioned, for example, epoxy resins and phenolic resins (that is to say, condensation products of phenol or a substituted phenol such as, for instance, resorcinol with an aldehyde such as, for instance, formaldehyde).

Carbon microspheres offer the advantage that they are essentially odourless on combustion, whereas plastics materials such as phenolic resins, though enabling compositions to be made with satisfactory striking sensitivity, do tend to produce unpleasant odours on combustion.

Methods for making microspheres ae described, for example, in U.S. Pat. Nos. 2,797,201, 2,978,340, 3,030,215 and 3,796,777.

The microspheres will normally have gas or vapour encapsulated therein, and it will be appreciated that the chemical nature of any medium encapsulated will depend on the method of manufacture employed. For example, in the case of microspheres obtained from pulverised fuel ash (sometimes known as "fly ash"), a mixture of carbon dioxide and nitrogen is encapsulated.

It should also be mentioned that in the case of certain wall materials some diffusion of encapsulated gas through the microsphere walls will occur, either before or after deposition of the composition on a match stick, but this should not give rise to any difficulty.

The microspheres may have diameters in the range of from 10 to 1000 microns. It should be noted, however, that the presence of relatively large microspheres tends to give rise to problems in the so-called "dipping" operation by which a match-head composition is applied to the match stick, and also detracts from the appearance of the final match head. Based on these considerations, the diameters of the microspheres advantageously do not exceed 500 microns. A suitable size range for the microspheres is 60 to 360 microns. In the case of the siliceous microspheres sold as "Armospheres", the weight average particle diameter is normally of the order of 100 microns, and the size distribution may be such that from 10 to 20% by weight (preferably approximately 15% by weight) of the microspheres are below 50 microns in diameter and from 15 to 25% by weight (preferably approximately 20% by weight) above 125 microns. Such a distribution may also prove beneficial in the case of other siliceous microspheres.

It should be noted that with microspheres of larger diameters there is a tendency for the spheres to break up during the milling to which match-head compositions are conventionally subjected (to obtain a uniform distribution of constituents and to ensure that no large agglomerates are present). Such break-up is generally undesirable and can be avoided by incorporating such relatively large microspheres, with continuous stirring, after milling of the remainder of the composition. In general, compositions containing microspheres of up to approximately 250 microns in diameter may be milled without adverse results.

The wall thickness of the microspheres may lie within wide limits. As an indication, it may be said that the average density of the microspheres will generally be less than half that of the solid wall material. In the case of siliceous microspheres, the sphere density may be in the range of from 0.3 to 0.6 g/cc., more especially 0.4 to 0.6 g/cc., and the bulk density may be in the range of from 0.2 to 0.4 g/cc., more especially 0.25 to 0.4 g/cc.

If desired, the microspheres may be surface-coated, for example, with an adhesion-promoting agent, a burning rate catalyst (such as manganese dioxide), or a colorant, before incorporation in the match-head composition.

If desired, match-heads comprising compositions according to the invention can themselves be coated with a suitable water-proofing material, for example, nitrocellulose or shellac. This may be done by conventional methods.

The proportion of microspheres incorporated in a match-head composition according to the invention will depend on the type of composition sought and on the chemical constitution of the microspheres.

In the case of microspheres comprising a siliceous or other inert material, the spheres may be considered as a replacement (which may be total or partial) for the inert fillers used hitherto. In general, a match-head composition according to the invention will comprise from about 20% to about 33% by weight of so-called inert filler material (based on the dry weight of the composition). Inert microspheres may typically constitute at least 25% of the filler material and the remainder, if any, may comprise, for example, zinc oxide, Plaster of Paris or one or more siliceous materials such as, for instance, flour glass, felspar, or china clay. Typically, a dry match-head composition according to the invention may contain from 1 to 33% by weight of microspheres.

A match-head composition according to the invention may be of the following general formula, in which all percentages are by weight and based on the dry weight of composition:

| | % |
|---|---|
| Potassium chlorate | 35 - 65 |
| Combustibles | 5 - 20 |
| Binder | 7 - 20 |
| Inert Filler material | 20 - 33 |
| Colorant | 0 - 1 |
| Burning rate catalyst | (as necessary). |

The above formulation is given by way of preferred illustration, and it will be appreciated that the proportion of one or more of the constituents may be varied so as to fall outside the preferred limits quoted. For example, it is possible to make a strikable match-head composition having no inert filler material, as much as 23% binder by weight, and 15% by weight of phenol-formaldehyde microspheres as combustible material. It is also possible to raise the total combustible content as high as 27% by weight or more. In general, however, optimum results may be expected from compositions within the general formula given above.

As combustible material there may be mentioned, for example, sulphur, starches, natural gums, phosphorus sesquisulphide, carbon black, charcoal, and suitable combinations thereof. The binder may comprise, for example, animal glue, a natural gum or a synthetic resin (or a suitable mixture of two or more such materials), and the inert material may comprise microspheres, optionally together with one or more of the other inert fillers already mentioned. The colorant may comprise any suitable pigment or dyestuff.

It will be appreciated that certain binders may also serve as combustible materials and such factors should of course be taken into account in formulating the composition. In this connection, it should be noted that microspheres made of a plastics material or carbon may be considered as a replacement for all or part of the normal "combustible" content of a match-head composition.

The incorporation of microspheres into match-head compositions does not require any major change in the mixing and milling procedures normally used in formulation except that, as explained hereinbefore, it may be desirable to incorporate relatively large microspheres after milling of the remainder of the composition.

By way of example, one method of formulation will now be described in general terms. The ingredients should be mixed as a slurry, in accordance with established practice, and the preferred liquid vehicle for this purpose is water. It will be appreciated that the temperature conditions during operations 2 to 6 below should be maintained such as to facilitate mixing and milling, as the case may be.

1. Prepare the binder and establish temperature conditions in which it is in liquid form,
2. Incorporate the colorant (if a dyestuff) followed by the combustible material (for example, sulphur or phosphorus sesquisulphide), stirring continuously.
3. With continuous stirring incorporate inert filler material, pigment (if used), burning rate catalyst (if used), and microspheres.
4. When all the material is well wetted, incorporate the oxidant (normally potassium chlorate), maintaining continuous stirring.
5. After thorough mixing, the resulting mixture may be milled to obtain uniform dispersion of constituents and to ensure that no large agglomerates are present.
6. Incorporate microspheres with stirring (in addition to or instead of addition at step 3).
7. In accordance with normal practice, adjust the rheology of the composition, if necessary, (for example, by changing the temperature and/or the proportion of the liquid vehicle) to render it suitable for match making.

The following Examples illustrate the invention, the percentage of each constituent being by weight and based on the dry weight of the composition. The compositions described in the Examples may be made according to the general principles outlined at 1 to 7 above.

EXAMPLE 1

| | % |
|---|---|
| Safety-match composition: | |
| Potassium Chlorate | 50 |
| Animal Glue | 12.5 |
| Microspheres (siliceous) | 12 |
| Zinc Oxide | 1 |
| Colorants (synthetic Iron Oxide) | 2.5 |
| Sulphur | 5.5 |
| Manganese Dioxide | 9.0 |
| Diatomaceous Earth | 5.5 |
| Potassium Dichromate | 1.0 |
| Hydroxethyl Cellulose | 1.0 |

EXAMPLE 2

| | % |
|---|---|
| "Strike-anywhere" composition : | |
| Potassium Chlorate | 35 |
| Animal Glue | 17 |
| Microspheres (siliceous) | 19 |
| Phosphorus Sesquisulphide | 7 |
| Zinc Oxide | 6 |
| Plaster of Paris* | 15.5 |
| Dye | 0.5 |

*e.g. "White Heather Fine Casting Plaster" obtained from British Gypsum Industries Ltd.

EXAMPLE 3

| | % |
|---|---|
| Book-match composition: | |
| Potassium Chlorate | 55 |
| Zinc Oxide | 5 |
| Flour Glass | 7.5 |
| Microspheres (siliceous) | 7.5 |
| Diatomaceous Earth | 6.25 |
| Sulphur | 5.0 |
| Potassium Dichromate | 0.75 |
| Dye | 0.25 |
| Starch | 2.25 |
| Gum Tragacanth | 0.5 |
| Animal Glue | 10.0 |

EXAMPLE 4

| | % |
|---|---|
| Safety-match composition: | |
| Potassium Chlorate | 49.67 |
| Microspheres (siliceous) | 30.08 |
| Sulphur | 5.54 |
| Animal Glue | 12.43 |
| Potassium Dichromate | 1.14 |
| Hydroxyethyl Cellulose | 1.14 |

EXAMPLE 5

| | % |
|---|---|
| Safety-match composition: | |
| Potassium Chlorate | 49.67 |
| Manganese Dioxide | 8.88 |
| Iron Oxide | 2.16 |
| Microspheres (siliceous) | 12.20 |
| Diatomaceous Earth | 5.63 |
| Zinc Oxide | 1.16 |
| Sulphur | 5.56 |
| Potassium Dichromate | 1.16 |
| "Natrosol" | 1.16 |
| Animal Glue* | 12.42 |

*e.g. "293 Glue" obtained from Croda Polymers Ltd.

As will be understood by those skilled in the art, "Natrosol" (e.g. 'Natrosol' 250G obtained from Hercules Powder Co.) may be regarded either as a combustible component or as a binder-extender.

The siliceous microspheres used in the match-head compositions of the Examples above (and in Example 11 below) were those sold under the trade name "Armospheres", but it will be appreciated that other siliceous microspheres could be used in those compositions instead. It will also be appreciated that animal glues are normally regarded as essentially non-foaming in character.

EXAMPLE 6

| | % |
|---|---|
| Safety-match composition: | |
| Potassium Chlorate | 49.67 |
| Animal Glue | 12.43 |
| Ceramic Microspheres* | 12.19 |
| Zinc Oxide | 1.14 |
| Synthetic Iron Oxide | 2.20 |
| Sulphur | 5.54 |
| Manganese Dioxide | 8.89 |
| Diatomaceous Earth | 5.66 |
| Potassium Dichromate | 1.14 |
| Natrosol | 1.14 |

*e.g. Eccospheres FA-A supplied by Emerson & Cumming Inc.

Matches made using the compositions of Examples 1 to 6 respectively were compared by a panel of experts with corresponding conventional aerated safety and "strike anywhere" matches, and were found to have improved sensitivity in each case.

EXAMPLE 7

| | % |
|---|---|
| Safety-match composition: | |
| Potassium Chlorate | 59.0 |
| Binder | 23.0 |
| Microspheres (phenolic resin type) | 15.0 |
| Potassium Dichromate | 1.0 |
| "Natrosol" | 2.0 |

In the composition of Example 7, the phenolic microspheres may be regarded as combustible components; the composition, though somewhat soft, nevertheless was ignitable by striking. By way of comparison, an otherwise similar composition but containing starch (a combustible material commonly used in match-head compositions) could only be ignited with difficulty by striking.

EXAMPLE 8

| | % |
|---|---|
| "Strike-anywhere composition": | |
| Potassium Chlorate | 40.39 |
| Binder | 17.24 |
| Microspheres (phenolic resin type) | 18.79 |
| Phosphorus Sesquisulphide | 8.30 |
| Zinc Oxide | 6.16 |
| Plaster | 8.81 |
| Dye | 0.32 |

EXAMPLE 9

| | % |
|---|---|
| "Strike-anywhere composition": | |
| Potassium Chlorate | 47.30 |
| Binder | 20.20 |
| Microspheres (phenolic resin type) | 4.86 |
| Phosphorus Sesquisulphide | 9.72 |
| Zinc Oxide | 7.21 |

-continued

| | % |
|---|---|
| Plaster | 10.33 |
| Dye | 0.38 |

Examples of phenolic resin type microspheres which may be used in the compositions of Example 7 to 9 are "microballoons" as supplied by B. & K. resin Co. Ltd.

EXAMPLE 10

| | % |
|---|---|
| Book-match composition: | |
| Potassium Chlorate | 54.76 |
| Zinc Oxide | 4.98 |
| Flour Glass | 7.78 |
| "Armospheres" (siliceous microspheres) | 7.78 |
| Diatomaceous Earth | 6.22 |
| Sulphur | 4.98 |
| Potassium Dichromate | 0.78 |
| Rhodamine Dye | 0.19 |
| Starch | 2.18 |
| Gum Tragacanth | 0.39 |
| Croda 293 Glue | 9.96 |

In order to provide a basis for comparison with the match-head composition of Example 10, the following book-match composition (10A) was prepared:

| | % |
|---|---|
| Potassium Chlorate | 54.6 |
| Zinc Oxide | 4.98 |
| Flour Glass | 15.56 |
| Diatomaceous Earth | 6.22 |
| Sulphur | 4.98 |
| Potassium Dichromate | 0.78 |
| Rhodamine Dye | 0.19 |
| Starch | 2.18 |
| Gum Tragacanth | 0.39 |
| Croda High Foam Glue | 9.96 |

The comparison composition 10A differs in two respects from the composition of Example 10. Firstly, flour glass is used in place of the siliceous microspheres; and, secondly, the low foaming Croda 293 glue is replaced by a relatively expensive high-foam glue of the kind previously regarded as essential for the preparation of a good quality book-match composition. A composition such as 10A would normally be regarded as having something approaching the optimum striking sensitivity hitherto obtainable.

Matches made using the composition of Example 10 according to the invention were compared in user preference tests (the method conventionally used to evaluate comparative striking sensitivity and other properties) with matches made using the comparison composition 10A. The tests showed a 66% preference for the composition of Example 10, and the 95% statistical confidence limits were 56% and 74%, showing a very definite preference for the composition of the invention.

EXAMPLE 11

| "Double dip" composition: Main bulb | % |
|---|---|
| Potassium Chlorate | 41.60 |
| Flour Glass | 13.37 |
| Plaster of Paris | 7.80 |
| Zinc Oxide | 2.60 |
| China Clay | 3.72 |
| Sulphur | 8.17 |
| Calcium Resinate | 2.97 |
| Amorphous Phosphorus | 2.23 |
| Bordeaux Red 10495 Dye | 2.97 |
| Potassium Dichromate | 0.09 |
| Animal Glue | 13.37 |
| Gum Arabic | 0.74 |
| Gum Tragacanth | 0.37 |

-continued

| Tipping Composition | |
|---|---|
| Potassium Chlorate | 41.53 |
| Microspheres (siliceous) | 13.58 |
| Plaster of Paris | 7.99 |
| Zinc Oxide | 7.99 |
| China Clay | 3.99 |
| Phosphorus Sesquisulphide | 9.58 |
| Animal Glue | 15.34 |

The reason why the use of microspheres in match-head compositions enables good sensitivity and burning rate to be achieved without aeration as hitherto practised is not fully understood. Previously proposed methods of aeration involving, for example, the use of foaming glues, are generally regarded as producing a form of interconnected structure in which some of the air cells are in mutual communication. It is believed that the resulting channels contribute to sensitivity and uniform burning rate by facilitating flame propagation and escape of combustion products. Surprisingly, however, microscopic examination of ash from compositions incorporting inert siliceous microspheres has shown that a significant proportion of the atmospheres do not burst on combustion. Moreover, it is noteworthy that microspheres for use in accordance with the invention need not necessarily have any air encapsulated therein.

The accompanying drawing shows, by way of example, a diagrammatic section through the head of a match bearing a head composition having a content of microspheres according to the invention. The head is indicated generally by the reference numeral 1 and the match stick or splint by the numeral 2. The microspheres are represented by open circles (some of which have been marked 3) and are shown approximately to scale in relation to the head 1 and stick 2. The walls of certain of the microspheres (indicated by 3') are represented by double lines to illustrate their thickness in relation to the overall size of the spheres.

We claim:

1. In a match-head composition, the improvement which comprises incorporating therein, as a strike sensitizer, from 1-33% by weight of hollow microspheres of siliceous material having a melting point above the combustion temperature of the match-head composition, said microspheres having diameters in the range 5 to 5000 microns, a sphere density in the range 0.3 to 0.6 g/cc and a bulk density in the range 0.2 to 0.4 g/cc.

2. A match-head composition according to claim 1, in which said microspheres are of a ceramic material.

3. A match-head composition according to claim 1, in which the microspheres are of glass.

4. A match-head composition according to claim 1, in which said microspheres have diameters in the range 60–360 microns.

5. A match-head composition according to claim 4, in which the microspheres have an average diameter of about 100 microns.

6. A match-head composition according to claim 4, in which the microspheres have a size distribution such that 10–20% by weight are below 50 microns in diameter and from 15–25% are above 125 microns in dimeter.

7. In a match, the improvement which comprises incorporating into the head thereof, as a strike sensitizer, from 1–33% by weight of hollow microspheres of siliceous material having a melting point above the combustion temperature of the match-head composition, said microspheres having diameters in the range 5 to 5000 microns, a sphere density in the range 0.3 to 0.6 g/cc and a bulk density in the range 0.2 to 0.4 g/cc.

8. A match according to claim 7, wherein said microspheres are of glass or ceramic material.

9. A match according to claim 7, wherein said microspheres have diameters in the range 60–360 microns.

* * * * *